United States Patent [19]

Sturm

[11] Patent Number: 4,667,378

[45] Date of Patent: May 26, 1987

[54] CLASP LOCK

[76] Inventor: Carolyn M. Sturm, Bahnhofstr. 11/4/30, A-9500 Villach, Austria

[21] Appl. No.: 785,890

[22] Filed: Oct. 9, 1985

[30] Foreign Application Priority Data

May 8, 1985 [EP] European Pat. Off. ..... 85 105 615.0

[51] Int. Cl.[4] ..... F16G 15/00

[52] U.S. Cl. ..... 24/616; 24/116 A; 63/2

[58] Field of Search ..... 24/616, 615, 617, 618, 24/116 A, 585, 589, 598, 237; 63/2

[56] References Cited

U.S. PATENT DOCUMENTS

| | | | |
|---|---|---|---|
| 889,230 | 6/1908 | Hoffman | 24/616 |
| 1,099,484 | 6/1914 | Brassler | 24/616 |
| 1,192,917 | 8/1916 | Lott | 24/616 |
| 1,238,495 | 8/1917 | Christ | 24/616 |
| 1,412,731 | 4/1922 | Wormser | 63/2 |
| 1,606,991 | 11/1926 | Gammell | 24/616 |
| 1,957,141 | 5/1934 | Jordan | 24/616 |
| 2,986,792 | 6/1961 | Wyatt | 24/616 |
| 3,947,932 | 4/1976 | Flynn | 24/616 |
| 4,426,854 | 1/1984 | Geldwerth et al. | 24/616 |
| 4,520,537 | 6/1985 | Valikov | 24/116 A |

FOREIGN PATENT DOCUMENTS

| | | | |
|---|---|---|---|
| 144427 | 6/1920 | United Kingdom | 24/616 |

*Primary Examiner*—Victor N. Sakran

*Attorney, Agent, or Firm*—Peter K. Kontler

[57] ABSTRACT

A clasp lock whose clasp is a homogeneous one-piece U-shaped metallic casting having a rigid leg, a resilient leg and a rigid web which is integral with one end portion of the rigid leg as well as with one end portion of the resilient leg and is first to enter the chamber of the receptacle when the clasp is inserted through the opening in the front wall of the receptacle. The cross-sectional area of one or more parts of the intermediate portion of the resilient leg diminishes gradually or abruptly in a direction from one toward the other end portion of such leg.

32 Claims, 4 Drawing Figures

CLASP LOCK

BACKGROUND OF THE INVENTION

The present invention relates to locks in general, and more particularly to improvements in so-called clasp locks or self-locking spring locks which can be utilized to releasably couple the end portions of necklaces, bracelets, chains and/or other articles of jewelry. Still more particularly, the invention relates to improvements in locks of the type wherein the front wall of an elongated hollow receptacle is provided with an opening for introduction of a deformable clasp which can be inserted into the receptacle only upon deformation and is automatically locked in the inserted position in response to relaxation or termination of deforming pressure.

As a rule, the clasp of a conventional clasp lock has a relatively rigid leg and a resilient leg one end portion of which is soldered or welded to one end portion of the rigid leg and the other end portion of which must be depressed toward the rigid leg in order to permit insertion of the clasp into or its extraction from the receptacle. A drawback of such locks is that the cost of the clasp is relatively high, primarily because the two legs must be produced separately to be thereupon soldered or similarly bonded to each other in a time-consuming operation. The problem is aggravated if the clasp is small or very small which is desirable when the lock is used to couple portions of certain types of jewelry, i.e., the lock should be as unobtrusive as possible. In many instances, soldering of the two legs to each other must be followed by manual secondary treatment so as to ensure that the soldered-together end portions of the legs can penetrate into the receptacle by way of the opening in the front wall. Such secondary treatment is necessary for each of a short or long series of clasps, and the finished clasps cannot be used interchangeably (i.e., in conjunction with different receptacles) because, as a rule, each clasp is finished by hand so as to fit only into a particular receptacle.

Soldering of the legs to each other entails many additional problems. Thus, the soldered portion of the clasp is likely to fatigue after a relatively short period of use so that the resilient leg breaks away from the other leg and can cause loss of the article of jewelry whose ends are coupled to each other.

In accordance with another earlier proposal, the clasp is obtained from an elongated blank which is bent in or close to the middle through an angle of approximately 180 degrees to form two legs which partially or fully overlap each other. Such clasps also break in the region of the junction between the two legs due to fatigue of their material after a relatitely short period of use, i.e., after a relatively small number of flexures of one of the legs with reference to the other leg. In addition, the above described clasps must be discarded even in the absence of a total break if the aging or fatigue of their material is sufficiently advanced to prevent return movement of the resilient leg to its normal or unstressed position because return movement to such position is a prerequisite for adequate anchoring of the fully inserted clasp in the receptacle.

OBJECTS AND SUMMARY OF THE INVENTION

An object of the invention is to provide a novel and improved clasp lock whose useful life is longer than that of heretofore known locks.

Another object of the invention is to provide a novel and improved clasp for use in the above outlined lock.

A further object of the invention is to provide a novel and improved receptacle for use in the above outlined lock.

An additional object of the invention is to provide a clasp whose cost is a fraction of that of many heretofore known clasps but which is much more reliable than the conventional clasps.

Still another object of the invention is to provide a clasp which can be mass-produced at a fraction of the cost of conventional clasps with no secondary treatment or with a minimum of secondary treatment.

A further object of the invention is to provide a novel and improved method of making the clasp.

Another object of the invention is to provide a clasp which can be utilized interchangeably in conjunction with any desired number of discrete receptacles and vice versa.

An additional object of the invention is to provide the lock with novel and improved means for releasably holding the clasp in the receptacle.

A further object of the invention is to provide the lock with novel and improved means for guiding the clasp during insertion into or extraction from the receptacle.

Another object of the invention is to provide a clasp lock which can be mass-produced from a wide variety of materials, which is unobtrusive on an article of jewelry or the like, and which can be readily manipulated by children as well as by adults of all age groups.

A further object of the invention is to provide a lock whose constituents can be attached to articles of jewelry or the like in any one of a number of different ways.

The invention resides in the provision of a lock for chains, necklaces, other articles of jewelry and the like. The lock comprises a receptacle which defines a chamber and has a front wall which bounds a portion of the chamber and has an opening in communication with the chamber. The receptacle can constitute an elongated parallelepiped with a substantially square cross-sectional outline and the front wall at one of its ends. The lock further comprises a substantially U-shaped clasp having a first elongated leg including spaced-apart first and second end portions and an at least substantially rigid elongated intermediate portion, an elongated second leg having first and second end portions and an at least partially resilient elongated intermediate portion including at least one preferably elongated part whose cross-sectional area diminishes in a direction from one toward the other end portion of the second leg, and a rigid yoke or web which is integral with the first end portions of both legs. The resilient intermediate portion of the second leg normally maintains the second end portion of the second leg in a first position (normal position) at a predetermined distance from the second end portion of the first leg but the second end portion of the second leg is movable to a second position nearer to the second end portion of the first leg in response to the application of a force which overcomes the resistance of the intermediate portion of the second leg. The opening in the front wall of the receptacle is dimensioned in such a way that it permits insertion of the web and of the intermediate portions of the legs into and extraction of the web and intermediate portions of the legs from the chamber only while the second end portion of the second leg assumes the aforementioned second position.

The clasp is preferably a one-piece homogeneous casting which is or can be made of a noble metal, particularly silver, gold or platinum (the same applies for the receptacle). Various parts of the clasp can be imparted an optimum rigidity and resiliency by adequate quenching and/or heating within a predetermined temperature range, depending upon the composition of the material of the casting. For example, if the clasp is made of 14 or 18 karat gold, the entire casting can be quenched at a temperature between zero and 50° C., preferably between zero and 20° C. (such as the temperature of cold water). The web and the intermediate portion of the second leg can be quenched at the same temperature as all other portions of the clasp.

The intermediate portions of the two legs are or can be at least substantially parallel to each other in the first position of the second end portion of the second leg to define an elongated slot whose width may but need not be constant all the way between the first and second end portions of the two legs when the second end portion of the second leg is free to assume the first position under the action of the resilient intermediate portion of the second leg.

The cross-sectional area of the aforementioned part of the intermediate portion of the second leg preferably diminishes in a direction from the web toward the second end portion of the second leg. Alternatively or in addition thereto, the cross-sectional area of the second part of the intermediate portion of the second leg can diminish in a direction from the second end portion toward the first end portion of the second leg. The cross-sectional area of the one and/or the other part of the intermediate portion of the second leg can diminish gradually or abruptly (e.g., in stepwise fashion). For example, the second leg can have a concave exposed surface which faces away from the first leg so that the thinnest portion of the second leg is located substantially or exactly midway between the two end portions of the second leg. The arrangement is preferably such that the thickest portion of one part of the intermediate portion of the second leg is closely or immediately adjacent to the web and the thickest portion of the other part of the intermediate portion of the second leg is closely or immediately adjacent to the second end portion of the second leg.

The lock further comprises detent means for releasably holding the web and the intermediate portions of the two legs in the chamber in response to return movement of the second end portion of the second leg to its first position under the action of the resilient intermediate portion of the second leg (i.e., when the clasp is properly inserted into the receptacle and the intermediate portion of the second leg is free to dissipate at least some energy which is stored while the second end portion of the second leg is caused to move from the first to the second position). Such detent means can comprise a first detent portion on the second leg and a second detent portion provided on the front wall of the receptacle. For example, the first detent portion can be provided with a socket which receives the second detent portion in the first position of the second end portion of the second leg and which is moved away from the second detent portion in response to movement of the second end portion of the second leg to its second position. The socket can constitute a recess or groove which extends transversely of the second leg, and the second detent portion can constitute an integral part of the front wall. The thickness of the front wall (and more particularly of that portion of the front wall which constitutes the second detent portion) preferably matches or approximates the width of the recess, as measured in the longitudinal direction of the second leg. This ensures that the detent means can hold the clasp in properly inserted position without any or with negligible wobbling and/or other types of stray movement.

The front wall of the receptacle is preferably provided with two spaced-apart (for example, at least substantially parallel) edge faces one of which is provided on the aforementioned second detent portion. The second leg of the clasp is preferably provided with a protuberance in the form of a tooth having a top land which is immediately adjacent to the socket of the first detent portion and is disposed at a variable distance from that (exposed) surface of the first leg which faces away from the second leg of the clasp. The distance between the top land of the tooth and the exposed surface of the first leg in the first position of the second end portion of the second leg exceeds the distance between the two edge faces of the front wall so that it is necessary to depress the second end portion of the second leg in order to move the top land of the tooth nearer to the exposed surface of the first leg before the person manipulating the lock can insert the web and the intermediate portions of the two legs into the chamber to such an extent that the second detent portion registers with the socket and the socket can receive the second detent portion in response to relaxation of pressure upon the second end portion of the second leg so that such second end portion can move to its first position under the action of the resilient intermediate portion of the second leg. The exposed surface of the first leg slides along the other edge face of the front wall during insertion of the clasp into or during its extraction from the chamber of the receptacle by way of the opening in the front wall. The depth of the socket, as measured at right angles to the longitudinal direction of the second leg, preferably equals or approximates the difference between the widths of that portion of the aforementioned slot between the second end portions of the two legs in the first and second positions of the second end portion of the second leg. The distance between the bottom surface of the second leg in the aforementioned socket and the exposed surface of the first leg in the first position of the second end portion of the second leg preferably matches or approximates the distance between the two edge faces of the front wall of the receptacle.

At least a portion of the second end portion of the second leg is preferably configurated and/or dimensioned in such a way that it cannot enter the opening of the front wall of the receptacle; this imposes the desired limits upon the extent of possible penetration of the clasp into the receptacle by way of the opening in the front wall. The width of the two second end portions, as measured transversely of the two legs in the inserted position of the clasp, can equal or approximate the width of the receptacle, especially the width of the front wall. The second end portion of the second leg has an exposed surface which can be depressed by a finger to move such second end portion from the first to the second position against the opposition of the resilient intermediate portion of the second leg. Such exposed surface of the second end portion of the second leg can be provided with one or more transversely extending grooves or other irregularities in order to facilitate its engagement by a finger, i.e., the finger is less likely to slide off the second end portion of the second leg. Each groove of such exposed surface can have a substantially triangular (V-shaped) cross-sectional outline.

The front wall of the receptacle and the clasp can be provided with cooperating guide means for permitting insertion of the web into the chamber only in a single predetermined orientation of the receptacle and the clasp with reference to each other. For example, the guide means can comprise a projection on the web and a complementary channel which is provided in the front wall and communicates with the opening to receive the projection during introduction of the web into the chamber. The projection can extend outwardly beyond the first end portion of the second leg in a direction away from the first end portion of the first leg. Such projection can be elongated, as considered in the longitudinal direction of the first leg, and can have a leader or tip which tapers in a direction away from the second end portions of the legs. For example, such leader can have two rounded lateral surfaces which are mirror symmetrical to each other with reference to a plane extending from the first to the second end portions of and halving the legs as well as the web.

The novel features which are considered as characteristic of the invention are set forth in particular in the appended claims. The improved lock itself, however, both as to its construction and the mode of manipulating the same, together with additional features and advantages thereof, will be best understood upon perusal of the following detailed description of certain specific embodiments with reference to the accompanying drawing.

DESCRIPTION OF THE PREFERRED EMBODIMENTS

Figure 3:
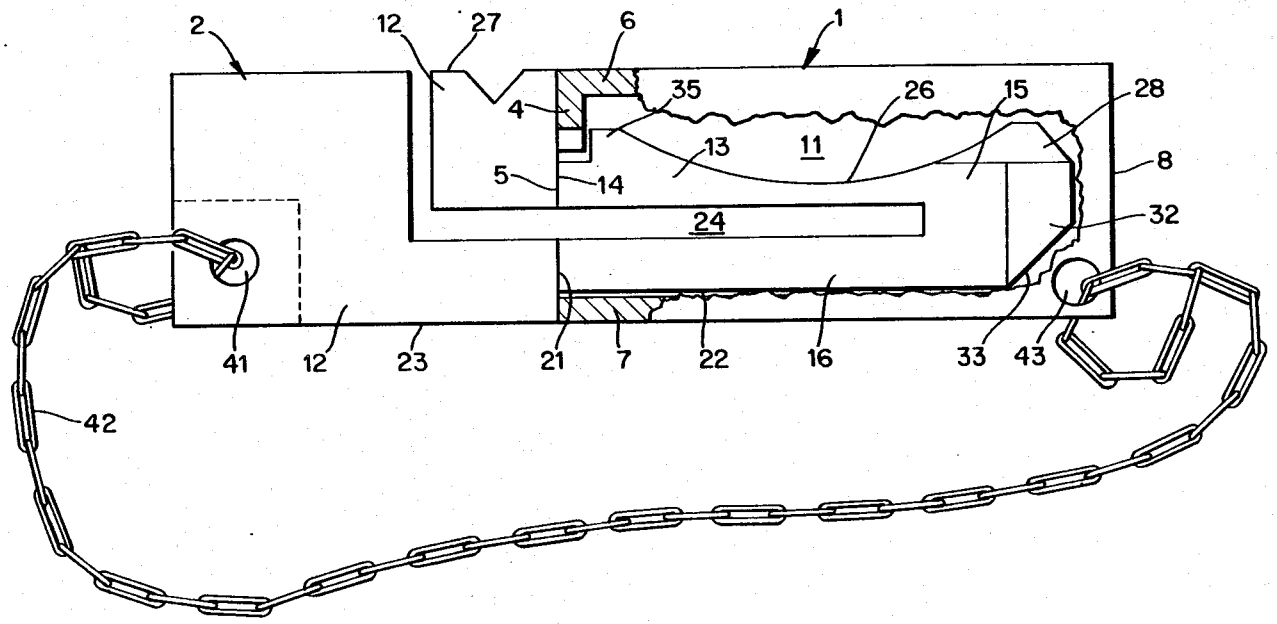
FIG. 3 is a side elevational view of the assembled lock with a portion of the receptacle broken away, the clasp and the receptacle being connected to the ends of a chain.

FIG. 3 shows, somewhat schematically and partly in a longitudinal sectional view, a clasp lock or self-locking spring lock which embodies one form of the invention and whose components are affixed to the respective ends of a piece of jewelry in the form of a link chain 42 normally made of silver, gold, platinum or another noble metal. One component of the improved lock is an elongated block-shaped hollow receptacle 1 which can be made of a noble metal (e.g., the same as that of the chain 42) and defines an internal chamber 11. The front wall 4 of the receptacle 1 has a substantially square or slightly rectangular opening 5 (see particularly FIG. 4) bounded by two parallel edge faces 20, 20*a* and disposed nearer to the bottom wall 7 than to the top wall 6 of the receptacle 1. The latter further includes a rear wall 8 and two longitudinally extending sidewalls 9, 10 alternating with the walls 6 and 7.

Figure 1:
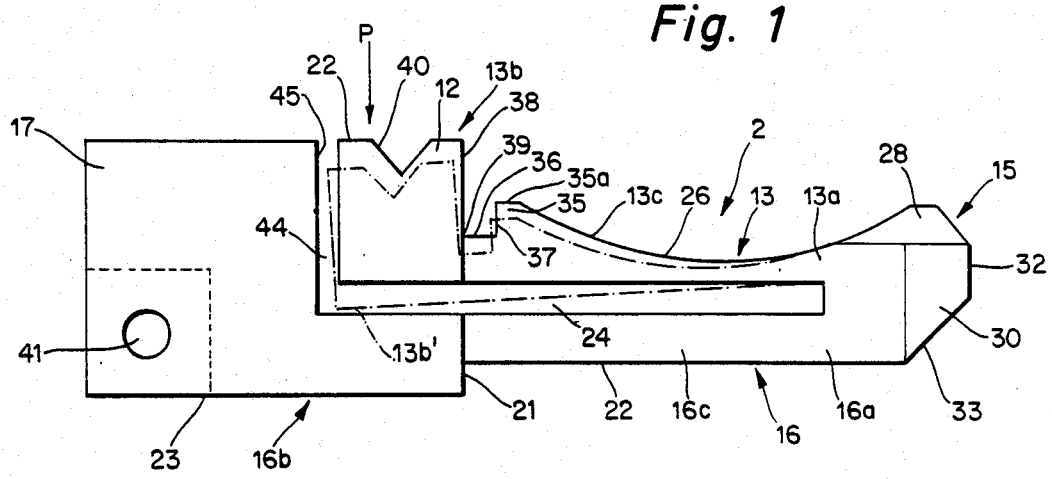
FIG. 1 is, an enlarged elevational view of the clasp, with the second position of the second end portion of the second leg shown by broken lines.

The second component of the improved lock is a substantially U-shaped clasp 2 whose material is preferably but not necessarily identical with that of the receptacle 1. As can be best seen in FIGS. 1 and 2, the clasp 2 comprises an elongated first leg 16 having a first end portion 16*a*, a spaced-apart second end portion 16*b* and an at least substantially rigid elongated intermediate portion 16*c* whose cross-sectional area is or can be constant all the way between the end portions 16*a* and 16*b*. The clasp 2 further comprises an elongated second leg 13 having a first end portion 13*a*, a spaced-apart second end portion 13*b* and an elongated resilient intermediate portion 13*c* whose cross-sectional area varies between the end portions 13*a* and 13*b*. Still further, the clasp 2 comprises a rigid web or yoke 15 which is integral with the end portions 13*a*, 16*a* of the respective legs 13, 16. The resiliency of the intermediate portion 13*c* suffices to normally maintain the second end portion 13*b* of the leg 13 in a (first) position which is shown in FIG. 1 by solid lines. When the person who manipulates the improved lock exerts a pressure in the direction of arrow P shown in FIG. 1, the second end portion 13*b* of the leg 13 is moved to a different (second) position 13*b*' which is indicated in FIG. 1 by broken lines. Such movement of the end portion 13*b* from the solid-line to the broken-line position of FIG. 1 takes place against the increasing opposition of the resiliently deformable intermediate portion 13*c* which thereby stores energy and tends to return the end portion 13*b* to the solid-line position.

The end portion 13*b* of the leg 13 has a width (as measured between the sidewalls 9 and 10 of the receptacle 1 in inserted position of the clasp 2) which exceeds the width of the opening 5 and the width of the intermediate portions 13*c*, 16*c* (see FIG. 2) so that a portion of the front surface 14 of the end portion 13*b* abuts against the exposed side of the front wall 4 in the fully inserted positions of the web 15 and intermediate portions 13*c* and 16*c*. In other words, the end portion 13*b* cooperates with the front wall 4 to limit the extent of penetration of the clasp 2 into the chamber 11 of the receptacle 1.

The legs 13 and 16 of the clasp 2 define an elongated slot 24 which extends from the web 15 between the intermediate portions 13*c* 16*c* and end portions 13*a*, 16*a* and whose width is or can be at least substantially constant when the intermediate portion 13*c* is free to maintain the end portion 13*b* in the solid-line (first) position of FIG. 1. The width of the slot 24 in the region of the end portions 13*b*, 16*b* diminishes and can be reduced to zero in response to movement of the end portion 13*b* to the phantom-line second position 13*b*' of FIG. 1.

The second end portion 16*b* of the leg 16 has an enlarged block-shaped part 17 whose cross-sectional area preferably matches or approximates that of the receptacle 1. The second end portion 13*b* is located between the part 17 and the intermediate portion 13*c* and is separated from the part 17 by a gap 44 whose width suffices to allow for movement of the end portion 13*b* between the two positions which are shown in FIG. 1. Thus, the front surface 45 of the part 17 should not obstruct the movements of the adjacent rearmost part of the end portion 13*b* between the solid-line and the phantom-line positions of FIG. 1.

The width of the opening 5 (as measured between the sidewalls 9 and 10 of the receptacle 1) equals or slightly exceeds the width of the legs 13, 16 and web 15. Also, the exposed surface 22 of the leg 16 (namely that surface which faces away from the leg 13) is preferably flat and slides along the edge face 20 of the front wall 4 during insertion or extraction of the clasp 2. The intermediate portion 13*c* of the leg 13 has a protuberance in the form of a tooth 35 which is immediately adjacent to a transversely extending recess or socket 36 of the end portion 13*b*. The tooth 35 has a top land 35*a* which is located at a predetermined distance from the exposed surface 22 of the leg 16 when the end portion 13*b* is free to assume the solid-line position of FIG. 1. Such distance exceeds the distance between the edge faces 20 and 20*a* of the front wall 4 so that the tooth 35 can enter the chamber 11 by way of the opening 5 only when the end portion 13*b* is depressed to assume the position 13*b*′ (at such time, the distance between the edge faces 20, 20*a* exceeds the distance between the top land 35*a* and the exposed surface 22). The opening 5 is flanked by two lateral portions 18, 19 which form integral parts of the front wall 4 and are contacted by the front surface 14 of the part 17 in the fully inserted position of the clasp 2. The distance between the exposed side of the bottom wall 7 of the receptacle 1 and the edge face 20 in the opening 5 preferably equals or approximates the distance between the bottom surface 23 of the part 17 and the exposed surface 22 of the leg 16. As can be seen in FIGS. 1 and 3, the rigid intermediate portion 16*c* as well as the part 17 of the second end portion 16*b* of the leg 16 define a shoulder 21 which extends outwardly beyond the exposed surface 22 and abuts against the corresponding part of the exposed side of the front wall 4 when the web 15 and the intermediate portions 13*c*, 16*c* are properly received in the chamber 11. The height of the shoulder 21 can equal or approximate the thickness of the wall 7.

The exposed surface 26 of the leg 13 is a concave surface which extends from the web 15 all the way to the top land 35*a* of the tooth 35 and ensures that the intermediate portion 13*c* comprises a first elongated part 113*c* which is adjacent to the web 15 and whose cross-sectional area diminishes gradually in a direction toward the end portion 13*b*, and a second part (213*c*) which is immediately adjacent to the tooth 35 and whose cross-sectional area diminishes gradually in a direction from the tooth 35 toward the web 15. The parts 113*c* and 213*c* determine the resiliency of the intermediate portion 13*c*. It is also within the purview of the invention to provide the intermediate portion 13*c* with one or more parts whose cross-sectional area diminishes abruptly (e.g., stepwise); however, care should be exercised to avoid the establishment of excessive differences in resiliency of immediately adjacent unit lengths of the intermediate portion 13*c* such as could cause breakage in response to repeated flexing of the portion 13*c* preparatory to extraction of the clasp 2, preparatory to insertion of the clasp, and upon completed insertion of the clasp into the receptacle 1. The web 15 is sufficiently rigid to ensure that it does not participate in deformation of the part 113*c* when the intermediate portion 13*c* must be flexed for the purpose of inserting, anchoring or extracting the clasp 2.

The web 15 has a slender elongated strip-shaped projection 28 which extends in the longitudinal direction of the legs 13, 16 and outwardly beyond the end portion 13*a*, i.e., in a direction away from the end portion 16*a*. The projection 28 constitutes the male component of a guide means serving to ensure that the receptacle 1 as well as the clasp 2 must assume a single predetermined orientation before the web 15 can be introduced into the opening 5. The female component of the guide means is that portion (4*a*) of the front wall 4 which is adjacent to the edge face 20*a* and is formed with a groove or channel 31 for the projection 28. Thus, the projection 28 must be aligned with the channel 31 before the person manipulating the improved lock can insert the web 15 into the chamber 11 by way of the opening 5.

The leader or tip 32 of the web 15 includes a part of the projection 28 and is bounded in part by two rounded lateral surfaces 29 and 30 which facilitate the advancement of projection 28 toward and into the channel 31 of the front wall 4. The underside 33 of the tip 32 tapers forwardly and is inclined with reference to the exposed surface 22 of the leg 16. The front end face of the projection 28 tapers in the opposite direction so that the entire tip 32 resembles a wedge which facilitates the task of the user in introducing the web 15 into the opening 5 in such a way that the projection 28 finds its way into the channel 31. The surfaces 29, 30 are mirror symmetrical to each other with reference to a plane which extends between the end portions 13*a*, 16*a* and 13*b*, 16*b* and halves the legs 13, 16 (as viewed in FIG. 2).

The socket 36 in the end portion 13*b* is bounded by the adjacent rear surface 37 of the aforementioned tooth 35, by a bottom surface 39 of the end portion 13*b*, and by a further surface 38 which is located opposite the surface 36 and is provided on an enlarged section 12 of the end portion 13*b*. The width of the section 12 can match or approximate the width of the part 17 (see FIG. 2), and the exposed surface 27 of the section 12 is formed with one or more transversely extending V-shaped grooves 40 which reduce the likelihood of slippage of a finger relative to the surface 27 when the section 12 is depressed in the direction of arrow P to move the end portion 13*b* from the solid-line position to the phantom-line position 13*b*′ of FIG. 1 i.e., to reduce the width of the corresponding portion of the slot 24 to zero or to a value preferably close to zero. The operator knows that the web 15 and the intermediate portions 13*c*, 16*c* of the legs 13, 16 can be inserted into the chamber 11 when the operator feels that the underside of the section 12 abuts against the inner side of the leg 16.

The width of the socket 36 (i.e., the distance between the surfaces 37 and 38 which flank the socket) equals or slightly exceeds the thickness of the corresponding (detent) portion 4*a* of the front wall 4 to thus ensure that the portion 4*a* can penetrate into the socket 36 to releasably hold the clasp 2 in properly inserted position as soon as the pressure upon the surface 27 is terminated or is relaxed sufficiently to ensure that the intermediate portion 13*c* can dissipate energy and can return the end portion 13*b* to the solid-line position of FIG. 1. The distance between the edge face 20*a* and the bottom surface 39 is or can be zero in the fully inserted position of the clasp 2, i.e., the intermediate portion 13*c* can bias the surface 39 against the edge face 20*a* when the pressure upon the surface 27 is relaxed or terminated while the edge face 20*a* registers with the socket 36. Furthermore, the height of the surface 37 (as measured in the direction from the top land 35*a* toward the exposed surface 22) preferably equals or approximates the width of the slot 24 in the region of the end portions 13*b*, 16*b* in undeformed condition of the intermediate portion 13*c*. Thus, the tooth 35 can slide outwardly and through the opening 5 only when the surface 27 of the section 12 of the end portion 13*b* is depressed to the extent which is necessary to move the top land 35*a* to a level below the edge face 20*a*, as viewed in FIG. 1.

The feature that the width of the surface 27 matches or approximates the width of the part 17 and the width of the receptacle 1 between the sidewalls 9 and 10 is desirable and advantageous because this ensures that the surface 27 can be properly depressed by a finger. It must be borne in mind that the structure of the present invention can constitute a miniature lock which can be used with advantage on necklaces and should not be prominent when the necklace is worn. Of course, the lock will be sturdier if it is used to separably connect the end portions of a relatively heavy chain or bracelet which is applied around the wrist. The illustrated V-shaped groove 40 can be replaced with a differently configurated and/or dimensioned and/or oriented groove, by a number of serrations or by any other configurations which reduce the likelihood of slippage of the finger relative to the section 12.

The part 17 of the second end portion **16*b* of the leg 16 has a transversely extending hole 41 for the respective end portion of the chain 42. The other end portion of the chain 42 extends through a transverse hole 43 in the receptacle 1 adjacent to the walls 7 and 8. The hole 41 can be omitted if the part 17 is provided with an eyelet which can be removably or permanently coupled to the respective end portion of the chain 42. The same holds true for the hole 43. Furthermore, the end portions of the chain 42 can be provided with bolts whose heads can be slipped into T-shaped grooves in the part 17 and receptacle 1** to be thereupon properly anchored so that they cannot be readily extracted from the respective grooves.

The receptacle 1 and the clasp 2 are or can be permanently or separably affixed to or made integral with the respective end portions of the chain 42 in the manufacturing plant or by a jeweler. If the owner wishes to apply the chain 42, the receptacle 1 and the clasp 2 are oriented relative to each other in such a way that the projection 28 of the web 15 is in exact or substantial alignment with the channel 31 before the web 15 is introduced into the opening 5. The aforementioned rounded and other surfaces 29, 30, 33 or facets of the tip 32 then ensure that the projection 28 finds its way into the channel 31 and the owner (or another person who is requested or ordered to apply the chain 42) thereupon depresses the section 12 by exerting a required force upon the exposed surface 27 so that the width of the adjacent portion of the slot 24 is reduced sufficiently to allow the tooth 35 to bypass the edge face **20*a* of the front wall 4. Once the web 15 and the intermediate portions 13, 16*c* are properly inserted (i.e., when the front surface 14 strikes the exposed side of the front wall 4), the pressure upon the surface 27 is relaxed or terminated so that the detent means including the wall portion 4*a* and the socket 36 becomes operative and retains the clasp 2 in the properly inserted position. The operation is carried out in reverse if the wearer wishes to remove the chain. Thus, the wearer or another person must depress the section 12 so that the tooth 35 can bypass the edge face 20*a* of the wall 4 in order to permit extraction of the intermediate portions 13*c*, 16*c* and the web 15 from the chamber 11 via opening 5**.

The concave surface 26 at the exposed side of the intermediate portion **13*c* of the leg 13 can be replaced with a flat surface which is substantially parallel to the exposed surface 22 of the leg 16 if the portion 13*c* is made resilient in another suitable way, e.g., by providing it with a concave inner surface which faces the leg 16. What counts is to ensure that the intermediate portion 13*c* can be flexed relative to the rigid or substantially rigid web 15 and leg 16. The cross-sectional area of certain part or parts of the intermediate portion 13*c* can be substantially less than the cross-sectional area of the web 15. The concave surface 26 can but need not extend all the way to the top land 35*a* of the tooth 35**.

Figure 2:
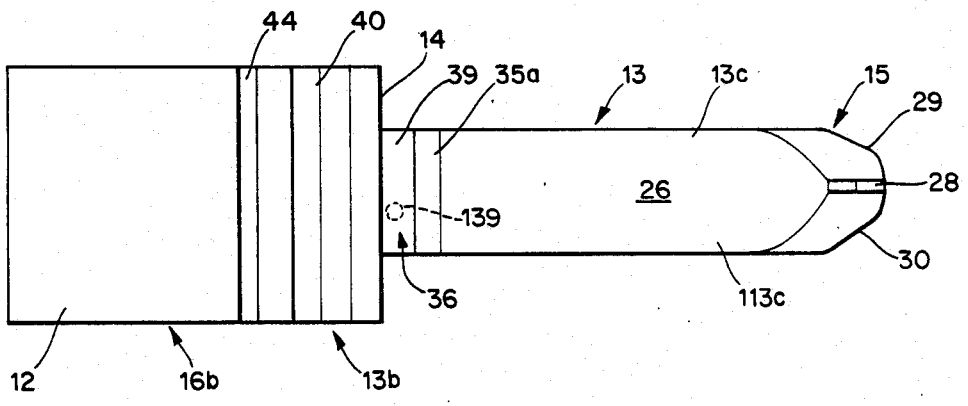
FIG. 2 is a plan view of the clasp.
Figure 4:
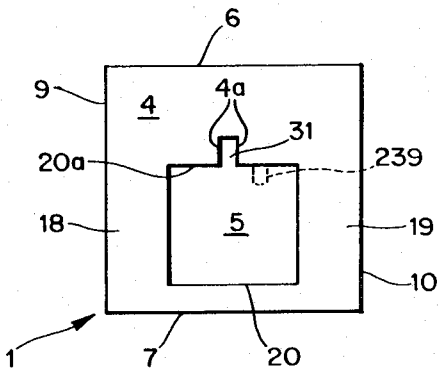
FIG. 4 is a front elevational view of the receptacle as seen from the left-hand side of FIG. 3.

In accordance with a modification which is shown by broken lines in FIGS. 2 and 4, the bottom surface 39 in the socket 36 can be formed with one or more holes or sockets 139 for complementary male detent portions in the form of pins 239 extending from the edge face **20*a* and received in the respective hole or holes 139 when the clasp 2 is properly inserted in the receptacle 1. The distance between the tip of the pin 239 and the edge face 20 is selected in such a way that the hole 139 is located at a level below such pin when the section 12 is depressed so as to allow for extraction of the clasp 2 via openihg 5. The just described embodiment need not employ a clasp whose leg 13 has a tooth 35, i.e., such tooth is then optional because the detent means includes the hole 139 and the pin 239**.

The projection 28 of the web 15 also constitutes an optional but desirable and advantageous feature of the improved lock. The same holds true for the lateral surfaces 29, 30 of the tip 32 and for the inclined surface 33. For example, the projection 28 and the complementary channel 31 can be omitted if the illustrated (substantially or exactly square) opening 5 is replaced with a rectangular or other polygonal opening so that the surfaces surrounding such modified opening ensure that the web 15 can be inserted into the chamber 11 only when the clasp 2 and the receptacle 1 are properly oriented relative to each other, preferably in such a way that the clasp 2 can enter the chamber 11 only in a single predetermined orientation relative to the receptacle 1.

As mentioned above, the clasp 2 is preferably a one-piece homogeneous metallic casting without any welded, soldered or otherwise bonded components. Homogeneousness of the material of the clasp 2 is particularly important in the region of the web 15 and intermediate portion **13*c* of the leg 13 because these parts are most likely to develop cracks or to break in response to repeated depression of the section 12. The material of the clasp 2 need not always be a noble metal; for example, the clasp can be made of steel (the same as the receptacle 1), especially if the chain 42 need not or does not serve a decorative but rather a utilitarian purpose. The nature of heat treatment or cooling to which the clasp 2 and/or its parts are subjected to ensure homogeneousness of its material and adequate resiliency of the intermediate portion 13*c* (simultaneously with adequate rigidity of the web 15 and leg 16**) depends on the nature of the material of which the clasp is made.

An important advantage of a clasp which is a homogeneous one-piece metallic casting is that such clasp can be mass-produced with a high degree of precision and requires no secondary treatment or a minimum of secondary treatment. The clasp can be used interchangeably with any number of different receptacles which are preferably mass-produced by casting (e.g., in two pieces which are thereupon united) or by resorting to any other suitable mass-producing technique. It is also possible to provide the front wall of the receptacle with several openings and to utilize such receptacle with two or more clasps, e.g., to separably couple several strands of pearls, gold, silver or platinum chains or bracelets to each other by means of a single receptacle and a requisite number of clasps, one for each chain or bracelet.

For example, several receptacles and clasps can be used to join two or more strands of pearls into a longer chain.

Another important advantage of the improved clasp is that the web 15 is a rigid body in contrast to heretofore known clasps which must be flexed in the regions of those ends of their legs which are soldered to each other or are integral portions of a bent blank. As a rule, or at least in many instances, flexing of the leg 13 is spread out along the entire or along the major part of the intermediate portion 13*c* so that the likelihood of excessive localized flexing of the leg 13 is very remote. Thus, the improved clasp ensures that the flexing which is needed to move the end portion 13*b* between its two positions is spread out along the entire intermediate portion 13*c* or along a substantial part of such intermediate portion. Therefore, the useful life of the improved clasp is much longer that that of a conventional clasp which is obtained by soldering two metallic pieces to each other or by bending a metallic blank through 180 degrees.

The making of metallic clasps in the form of one-piece castings was considered impossible because experts in the relevant art were of the opinion that a leg which is an internal part of a casting cannot exhibit the resiliency which is required to ensure predictable and repeated anchoring in the receptacle of a clasp lock. It was now discovered that a casting is fully capable of exhibiting the desired resiliency, especially if the leg 13 is formed in the aforedescribed manner, i.e., with an intermediate portion 13*c* having one or more elongated parts (113*c*, 213*c*) whose cross-sectional area varies in a direction from one to the other of the end portions 13*a*, 13*b*. This ensures the aforediscussed spreading out of flexing of the intermediate portion 13*c* when the section 12 is depressed toward the leg 16 with attendant narrowing of the adjacent portion of the slot 24. Rigidity of the web 15 and leg 16 ensures that these parts are not deformed during depression of the section 12 so that the deformation is distributed longitudinally of the intermediate portion 13*c* of the leg 13.

A clasp which is a one-piece metallic casting can be made at a fraction of the cost of a conventional clasp (e.g., a soldered clasp or a clasp which is obtained in response to bending of the median portion of an elongated blank through approximately 180 degrees) and, in addition, the dimensions of any desired number of successively produced castings (in a particular mold) will be the same so that the thus obtained clasps can be used interchangeably. Interchangeable use of a particular clasp with two or more discrete receptacles does not necessitate any secondary treatment of the clasp, and one and the same clasp can be anchored in any one of two or more discrete receptacles with the same degree of reliability. This enables the owner of several pieces of jewelry to combine such pieces in a number of different ways to produce a variety of eye-pleasing effects. Such combination of various pieces of jewelry is not possible when the pieces are equipped with conventional clasp locks because it would necessitate prolonged and costly secondary treatment of the clasp before it could be used with two or more discrete receptacles. A clasp which is a homogeneous one-piece casting can be readily produced in such a way that the resiliency of its leg 13 matches the desirable optimum resiliency, for example, by proper selection and/or treatment of the metallic material. This ensures that the inserted clasp is held in the receptacle with a predictable force so that it cannot wobble and that it is highly unlikely to become accidentally detached from the receptacle.

It is clear that the improved lock can be provided with additional safety features, e.g., with an eyelet which is pivotably mounted on the part 17 of the end portion 16*b* and can engage an undercut pin or post on the receptacle 1 to further reduce the likelihood of accidental separation of the clasp 2 and receptacle 1 from each other. Moreover, the parts 1 and 2 can be movably connected to each other by a relatively short chain or the like.

The aforedescribed detent structure including the socket 36 and the portion 4*a* of the front wall 4 is simple but highly reliable. Such structure is formed in the course of the casting operation and with the required degree of precision to ensure reliable retention of the clasp 2 in the receptacle 1 but to allow rapid extraction of the clasp by the simple expedient of deforming an elongated part (113*c* and/or 213*c*) of the intermediate portion 13*c* of the resilient leg 13.

Longer useful life of the improved clasp is attributable to a considerable degree to the fact that deformation of the leg 13 is not localized but is spread out along the entire or along a substantial part of the intermediate portion 13*c*. Therefore, the material of the leg 13 does not exhibit fatigue even after a substantial number of deformations. Permanent deformation of the leg 13 in inserted position of the clasp 2, while the intermediate portion 13*c* urges the bottom surface 39 in the socket 36 against the edge face 20*a* of the front wall 4, is equally unlikely because the deformation is spread out along a substantial part of the portion 13*c*. Deformation of a substantial part of the intermediate portion 13*c* in response to depression of the section 12 of the end portion 13*b* toward the inner side of the leg 16 practically eliminates the possibility of pronounced concentration of deformation and of attendant stresses in a small portion of the leg 13 which, in turn, eliminates the likelihood of cracking or breakage of the leg 13, either at the locus of its junction with the web 15 or at any other location between the end portions 13*a* and 13*b*. Absence of a soldered joint between the leg 13 and the web 15 and/or between the web 15 and the leg 16 also reduces the likelihood of a break or crack in the clasp. Uniform and predictable homogeneousness of the material of the clasp 2 can be readily ensured by appropriate treatment (particularly quenching) of the casting.

The width of the slot 24 (in undeformed condition of the intermediate portion 13*c* of the leg 13) is preferably but need not be uniform. Such width should suffice to ensure that the section 12 must be depressed through a certain distance before the tooth 35 can be extracted by way of the opening 5 because the clasp 2 could be accidentally separated from the receptacle 1 if the tooth 35 were free to pass through the opening 5 in response to minimal deformation of the intermediate portion 13*c*.

The illustrated configuration of the intermediate portion 13*c* (with a concave external surface 26 which extends all the way from the top land 35*a* to the web 15) is desirable and advantageous because the region of maximum deformability of the leg 13 is remote from the end portions 13*a* and 13*b*, i.e., from the rigid web 15 and from the rigid section 12. Rigidity of the end portion 13*b* is desirable because this allows for the establishment of a reliable connection between the leg 13 and the front wall 4 when the wall portion 4*a* extends into the socket 36 and/or when the pin-shaped male detent portion 239 extends into the socket or hole 139.

It has been found that accidental separation of the clasp from the receptacle in ordinary use is practically impossible. Intentional unauthorized separation of the clasp from the receptacle would necessitate a destruction or very pronounced deformation of the front wall 4 so as to allow for extraction of the leg portions 13*b*, 13*c* and 16*a*, 16*c* as well as for extraction of the web 15 from the interior of the receptacle. The piece of jewelry, e.g., a gold chain, is much more likely to break than the clasp and/or the housing of the improved lock. Such resistance to accidental separation of the clasp from the receptacle is ensured without any safety devices in the form of chains, snap-on fasteners and/or others.

The clasp can be mass produced in the following way:

It is assumed that the material of the clasp is 14-karat gold. Such material is cast at a temperature of approximately 1050° C. into flasks or molds which, after investment burnout, are maintained at a temperature of approximately 350° C. Thus, the temperature differential between the molten metal and the molds is between approximately 600° and 650° C. The molds are agitated so that the cast metallic material is cooled in order to reduce the temperature differential to approximately 360° C. In the next step, the molds are quenched at a temperature of between zero and 50° C., preferably in cold water at a temperature of between zero and 10° C., to bring about a solidification of gold crystals.

The temperature of each portion of the clasp can be the same in the course of the entire casting, agitating and chilling operation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A lock for chains, necklaces, other articles of jewelry and the like, comprising a receptacle defining a chamber and including a front wall bounding a portion of said chamber and having an opening communicating with said chamber; and a substantially U-shaped clasp constituting a homogeneous metallic casting and including a first leg having first and second end portions and an at least substantially rigid intermediate portion, a second leg having first and second end portions and an at least partially resilient intermediate portion including a part whose cross-sectional area diminishes in a direction from one toward the other end portion of said second leg, said second leg having a substantially concave exposed surface extending at least between said first and second end portions thereof, and a web which is integral with the first end portions of said legs, the intermediate portion of said second leg normally maintaining the second end portion of said second leg in a first position at a predetermined distance from the second end portion of said first leg and the second end portion of said second leg being movable to a second position nearer to the second end portion of said first leg in response to the application of a force which overcomes the resistance of the intermediate portion of said second leg, said opening being dimensioned to permit insertion of said web and intermediate portions of said leg into and extraction of said web and said intermediate portions from said chamber only while the second end portion of said second leg assumes said second position, said chamber as well as said opening and said legs being dimensioned to allow the second end portion of said second leg to move at least close to said first position under the action of said resilient intermediate portion upon completed insertion of said web and the intermediate portions of said legs into said chamber.

2. The lock of claim 1, further comprising detent means for releasably holding said web and the intermediate portions of said legs in said chamber in response to return movement of the second end portion of said second leg to said first position under the action of the intermediate portion of said second leg.

3. The lock of claim 1, wherein said receptacle is a one-piece casting.

4. The lock of claim 1, wherein said casting is quenched at a temperature of between zero and 50° C.

5. The lock of claim 1, wherein the web and the intermediate portion of said second leg are quenched in cold water.

6. The lock of claim 1, wherein the intermediate portions of said legs are substantially parallel to each other and define an elongated slot in the first position of the second end portion of said second leg.

7. The lock of claim 1, wherein the cross-sectional area of said part of the intermediate portion of said second leg diminishes in a direction from the first toward the second end portion of said second leg.

8. The lock of claim 1, wherein the cross-sectional area of said part of the intermediate portion of said second leg diminishes abruptly.

9. The lock of claim 1, wherein said part of the intermediate portion of said second leg is closely adjacent to said web.

10. The lock of claim 1, wherein the cross-sectional area of said part of the intermediate portion of said second leg diminishes in a direction from the first toward the second end portion of said second leg and is adjacent to said web, the intermediate portion of said second leg further including a second part which is adjacent to the second end portion of said second leg and whose cross-sectional area increases in a direction from the first toward the second end portion of said second leg.

11. The lock of claim 1, further comprising detent means for releasably holding said web and the intermediate portions of said legs in said chamber in response to return movement of the second end portion of said second leg to said first position under the action of the intermediate portion of said second leg, said detent means comprising a first detent portion on said second leg and a second detent portion provided on said front wall.

12. The lock of claim 11, wherein said first detent portion has a socket which receives the second detent portion in the first position of the second end portion of said second leg and which is moved away from the second detent portion in response to movement of the second end portion of said second leg to said second position.

13. The lock of claim 12, wherein said socket is a recess extending transversely of said second leg and said second detent portion is an integral part of said front wall, said front wall having a predetermined thickness which matches or approximates the width of said recess as measured longitudinally of said second leg.

14. The lock of claim 1, wherein said front wall and said clasp comprise guide means for permitting insertion of said web into said chamber in a single predetermined orientation of said receptacle and said clasp relative to each other.

15. The lock of claim 14, wherein said guide means comprises a projection on said web and a complementary channel provided in said front wall and communicating with said opening to receive said projection during introduction of said web into said chamber.

16. The lock of claim 1, wherein said front wall has two spaced apart edge faces bounding portions of said opening, said second leg having a socket disposed in the region of said second end portion thereof and a tooth adjacent to said socket and disposed between such socket and the first end portion of said second leg, said tooth having a top land and said first leg having an exposed surface facing away from said second leg, the distance between said top land and said exposed surface in the first position of the second end portion of said second leg exceeding the distance between said edge faces and the distance between said edge faces exceeding the distance between said top land and said exposed surface in the second position of the second end portion of said second leg, said exposed surface being arranged to move along one of said edge faces and said tooth being arranged to move along the other of said edge faces during insertion of said web and said intermediate portions into as well as during extraction of said web and said intermediate portions from said chamber.

17. The lock of claim 16, wherein said legs define an elongated slot whose width in the region of said second end portions decreases from a first to a second value in response to movement of the second end portion of said second leg to said second position, the depth of said socket as measured in a direction from said top land toward said exposed surface being equal to or approximating the difference between said first and second values.

18. The lock of claim 16, wherein said second leg has a bottom surface in said socket and the distance between said bottom surface and said exposed surface in the second position of the second end portion of said second leg equals or approximates the distance between said edge faces.

19. The lock of claim 1, wherein a portion at least of the second end portion of said second leg is dimensioned in such a way that it cannot enter said chamber by way of said opening.

20. The lock of claim 1, wherein said front wall has a predetermined width, as measured transversely of said legs in the inserted positions of said web and said intermediate portions, and the width of the second end portion of said second leg equals or approximates said predetermined width.

21. The lock of claim 1, wherein the second end portion of said second leg has an exposed surface which is depressible by a finger to move such end portion from said first to said second position.

22. The lock of claim 21, wherein said exposed surface of the second end portion of said second leg has at least one transversely extending groove.

23. The lock of claim 22, wherein said groove has a substantially V-shaped cross-sectional outline.

24. The lock of claim 1, wherein said web has a projection extending outwardly beyond the first end portion of said second leg in a direction away from the first end portion of said first leg, and said front wall has a channel which communicates with said opening and receives said projection during insertion of said web into said chamber.

25. The lock of claim 24, wherein said projection is elongated as considered in the longitudinal direction of said legs.

26. The lock of claim 1, wherein said web has a leader which tapers in a direction away from the second end portions of said legs.

27. The lock of claim 26, wherein said tip has two substantially mirror symmetrical rounded lateral surfaces.

28. The lock of claim 1, wherein said clasp contains a noble metal.

29. The lock of claim 1, wherein said receptacle contains a noble metal.

30. A lock for chains, necklaces, other articles of jewelry and the like, comprising a receptacle defining a chamber and including a front wall bounding a portion of said chamber and having an opening communicating with said chamber; and a clasp constituting a one-piece homogeneous metallic casting including first and second legs each having a first and a second end portion and an intermediate portion, and a web integral with the first end portions of said legs, said web and the intermediate portion of said first leg being at least substantially rigid and the intermediate portion of said second leg being resilient and urging the second end portion of said second leg to a predetermined first position in which the second end portions of said legs are spaced apart from one another, the second end portion of said second leg being depressible to a second position nearer to the second end portion of said first leg in response to the application of a force which overcomes the resistance of the intermediate portion of said second leg and said opening being dimensioned to permit insertion of said web and the intermediate portions of said legs into and extraction of said web and said intermediate portions from said chamber only while the second end portion of said second leg is maintained in said second position.

31. As a novel article of manufacture, a substantially U-shaped metallic clasp comprising a first elongated leg having spaced-apart first and second end portions and an at least substantially rigid intermediate portion; a second elongated leg having spaced-apart first and second end portions and an intermediate portion; and an at least substantially rigid web integral with the first end portions of said legs, at least a substantial part of the intermediate portion of said second leg being resilient and such intermediate portion normally maintaining the second end portion of said second leg at a predetermined distance from the second end portion of said first leg, the second end portion of said second leg being movable toward the second end portion of said first leg against the opposition of said resilient part of the intermediate portion of said second leg whereby the entire resilient part of the respective intermediate portion undergoes deformation with attendant prevention of localized overstressing of said second leg in response to deformation of said part of the intermediate portion thereof, said legs and said web constituting a homogeneous one-piece metallic casting.

32. The clasp of claim 31, wherein said legs and said web constitute a homogeneous one-piece metallic casting. C

* * * * *